US011482364B2

(12) United States Patent
Tsuduki et al.

(10) Patent No.: US 11,482,364 B2
(45) Date of Patent: Oct. 25, 2022

(54) MULTILAYER COIL COMPONENT

(71) Applicant: Murata Manufacturing Co., Ltd., Kyoto-fu (JP)

(72) Inventors: Keiichi Tsuduki, Nagaokakyo (JP); Kenji Tanaka, Nagaokakyo (JP); Masashi Matsubara, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 973 days.

(21) Appl. No.: 16/201,900

(22) Filed: Nov. 27, 2018

(65) Prior Publication Data

US 2019/0164676 A1 May 30, 2019

(30) Foreign Application Priority Data

Nov. 29, 2017 (JP) ..... JP2017-228579

(51) Int. Cl.
*H01F 5/00* (2006.01)
*H01F 17/00* (2006.01)
(Continued)

(52) U.S. Cl.
CPC ..... *H01F 17/0013* (2013.01); *H01F 1/34* (2013.01); *H01F 17/0033* (2013.01);
(Continued)

(58) Field of Classification Search
CPC .. H01F 17/0013; H01F 17/0033; H01F 17/04; H01F 17/0093
(Continued)

(56) References Cited

U.S. PATENT DOCUMENTS 8,416,049 B2 * 4/2013 Inuduka ..... C03C 14/004 336/200
9,030,287 B2 * 5/2015 Motomiya ..... H01F 17/0013 336/233
(Continued)

FOREIGN PATENT DOCUMENTS

JP 2006-319009 A 11/2006
JP 2009283824 A * 12/2009
(Continued)

OTHER PUBLICATIONS

An Office Action; "Notification of Reasons for Refusal," Mailed by the Japanese Patent Office dated Feb. 3, 2020, which corresponds to Japanese Patent Application No. 2017-228579 and is related to U.S. Appl. No. 16/201,900; with English language translation.

*Primary Examiner* — Elvin G Enad
*Assistant Examiner* — Joselito S. Baisa
(74) *Attorney, Agent, or Firm* — Studebaker & Brackett PC

(57) ABSTRACT

A component main body has a multilayer structure having a thickness and in which a first dielectric glass layer in which an internal conductor is embedded and having a thickness is interposed between a pair of magnetic layers containing a ferrite material as a primary component, and each of a pair of second dielectric glass layers is disposed on one of principal surfaces of the pair of magnetic layers. First to fourth outer electrodes are disposed on both end portions of the component main body. The thickness of at least one of the pair of second dielectric glass layers that faces a mounting substrate is about 10 μm to 64 μm.

15 Claims, 3 Drawing Sheets

(51) Int. Cl.
*H01F 17/04* (2006.01)
*H01F 1/34* (2006.01)

(52) U.S. Cl.
CPC ..... *H01F 17/04* (2013.01); *H01F 2017/0066* (2013.01); *H01F 2017/0093* (2013.01)

(58) Field of Classification Search
USPC ..... 336/200
See application file for complete search history.

(56) References Cited

U.S. PATENT DOCUMENTS 9,373,435 B2 * 6/2016 Odahara ..... H01F 17/0013
9,865,388 B2 * 1/2018 Ishida ..... H01F 27/2804
10,096,417 B2 * 10/2018 Omori ..... H03H 7/09
10,930,420 B2 * 2/2021 Hachiya ..... H01F 17/0013
2009/0003191 A1 1/2009 Inuzuka et al.
2010/0201473 A1 8/2010 Konoue et al.
2011/0181384 A1 * 7/2011 Inuduka ..... H01F 17/0013 336/234
2013/0154786 A1 * 6/2013 Nakajima ..... H01F 5/003 336/200
2014/0220364 A1 * 8/2014 Umemoto ..... C03C 8/22 428/434
2014/0266545 A1 * 9/2014 Shiroki ..... H01F 27/2804 336/200
2017/0294257 A1 * 10/2017 Omori ..... H01F 27/292
2019/0080838 A1 * 3/2019 Katsuta ..... H01F 1/34

FOREIGN PATENT DOCUMENTS

JP 2013-118395 A 6/2013
JP 2013135087 A * 7/2013
JP 2017-073475 A 4/2017

* cited by examiner

MULTILAYER COIL COMPONENT

CROSS-REFERENCE TO RELATED APPLICATION

This application claims benefit of priority to Japanese Patent Application No. 2017-228579, filed Nov. 29, 2017, the entire content of which is incorporated herein by reference.

BACKGROUND

Technical Field

The present disclosure relates to a multilayer coil component and specifically to a multilayer coil component such as a multilayer common mode choke coil including magnetic layers disposed on both principal surfaces of a dielectric glass layer in which an internal conductor is embedded.

Background Art

To date, common mode choke coils have been widely used for removing common mode noise generated between signal lines or power source lines and ground (GND) in various electronic apparatuses.

In such a common mode choke coil, a noise component is transmitted in a common mode, a signal component is transmitted in a normal mode and, therefore, noise removal is performed while a signal is separated from noise with the help of the difference between these transmission modes.

Regarding the common mode choke coil, a compact, low-profile, multilayer-type common mode choke coil has been developed. A multilayer coil component having a multilayer structure including a pair of magnetic layers disposed on both principal surfaces of a dielectric glass layer in which a coil conductor is embedded is widely known as a multilayer common mode choke coil.

However, regarding this type of multilayer coil component, the dielectric glass layer sinters at low temperature, whereas firing of the magnetic layer is started at high temperature. Therefore, the dielectric glass layer and the magnetic layer differ in shrinkage behavior, and interlayer peeling may occur at the interface between the dielectric glass layer and the magnetic layer because of the above-described difference in shrinkage behavior. Meanwhile, the coefficient of linear expansion of the dielectric glass layer is usually smaller than the coefficient of linear expansion of the magnetic layer. Therefore, stress resulting from the difference in the coefficient of linear expansion between the two layers during the cooling step after firing may affect the interface between the dielectric glass layer and the magnetic layer and, thereby, interlayer peeling may also result.

For example, as illustrated in FIG. 4, Japanese Unexamined Patent Application Publication No. 2017-73475 (claim 1, FIG. 1, and the like) proposes a multilayer coil component in which a multilayer body 104 is prepared by forming magnetic layers 103*a* and 103*b* on both principal surfaces of a dielectric glass layer (nonmagnetic layer composed of a glass material) 102 in which a coil conductor 101 is embedded, dielectric glass layers (nonmagnetic layers) 105*a* and 105*b* are further formed on both principal surfaces of the multilayer body 104, and thereby, the multilayer body 104 is constrained by the dielectric glass layers 105*a* and 105*b* such that interlayer peeling does not occur between the dielectric glass layer 102 and the magnetic layer 103. However, according to Japanese Unexamined Patent Application Publication No. 2017-73475, when the multilayer coil component is mounted on a substrate, a structural defect, e.g., a crack, may occur in the dielectric glass layer in the vicinity of the substrate.

FIG. 5 is a sectional view illustrating the mounted state of the multilayer coil component. That is, in the multilayer coil component, outer electrodes 107*a* and 107*b* are disposed on both end portions of the component main body (chip main body) 106 including the multilayer body 104 and dielectric glass layers 105*a* and 105*b*, and the outer electrodes 107*a* and 107*b* are connected to a substrate 108 with solder 109 interposed therebetween.

Mounting on the substrate is usually performed by heating treatment using a reflow furnace and, therefore, thermal shock may be applied or the substrate 108 may be distorted during mounting. If thermal shock is applied or the substrate 108 is distorted as described above, tensile stress acts on the glass layer 105*b* that faces the substrate 108, and structural defects 110 and 111, e.g., cracks, may occur in a connection portions between the substrate 108 and the glass layer 105*b* or in the glass layer 105*b*.

SUMMARY

The present disclosure is realized in consideration of the above-described circumstances. Accordingly, the present disclosure provides a multilayer coil component, e.g., a multilayer common mode choke coil, having good reliability so as to suppress the occurrence of structural defects, e.g., cracks, even when thermal shock is applied or a substrate is distorted during mounting on the substrate.

In the multilayer coil component of a type in which a dielectric glass layer in which an internal conductor is embedded is interposed between a pair of magnetic layers, it is preferable that a pair of dielectric glass layers be further disposed as outer layers of a multilayer body in which a dielectric glass layer is interposed between a pair of magnetic layers and that the multilayer body be constrained by the pair of dielectric glass layers serving as the outer layers so as to avoid the occurrence of interlayer peeling at the interface between the dielectric glass layer and the magnetic layer.

It is known that a glass material constituting the dielectric glass layer has a smaller coefficient of linear expansion than a ferrite material that is a primary component of the magnetic layer. Therefore, compressive stress is applied to the dielectric glass layers that are in contact with the magnetic layer and that serve as the outer layers during a process of cooling from high temperature to ordinary temperature in baking treatment in a firing step and an outer electrode formation step. Also, it is known that as the compressive stress of the surface of the dielectric glass layer increases, the mechanical strength against external stress increases. In addition, as a result of intensive research by the present inventors, it was found that the thickness of the dielectric glass layer serving as the outer layer had an influence on the compressive stress.

The present inventors performed further research and found that when the thickness of the dielectric glass layer that faced the mounting substrate and that served as an outer layer of the magnetic layer was decreased to fall within a range of about 10 μm to 64 μm, the compressive stress could be sufficiently increased, thereby enhancing the mechanical strength, and the occurrence of structural defects, e.g., cracks, could be suppressed without the occurrence of interlayer peeling in the multilayer body.

The present disclosure is realized on the basis of the above-described findings. A multilayer coil component according to preferred embodiments of the present disclosure includes a pair of magnetic layers each disposed on one of principal surfaces of a first dielectric glass layer in which an internal conductor is embedded, and a pair of second dielectric glass layers each disposed on one of principal surfaces of the pair of magnetic layers. At least one of the pair of second dielectric glass layers has a thickness of about 10 μm to 64 μm. According to the above-described multilayer coil component, the compressive stress of the surface of the second dielectric glass layer can be enhanced, the mechanical strength can be improved, and the occurrence of structural defects, e.g., cracks, can thereby be suppressed without the occurrence of interlayer peeling in the multilayer body.

In the multilayer coil component according to preferred embodiments of the present disclosure, a ratio of the thickness of the one of the pair of second dielectric glass layers to a total thickness of one of the pair of magnetic layers and the one of the pair of second dielectric glass layers is preferably about 0.05 to 0.35. When the relationship between the thickness of the second dielectric glass layer and the thickness of the magnetic layer is set to be as described above, a desired low-profile multilayer coil component can be obtained.

In the multilayer coil component according to preferred embodiments of the present disclosure, preferably, the first dielectric glass layer and the pair of second dielectric glass layers contain a glass material in which a primary component is a borosilicate glass. Consequently, a multilayer coil component having good high-frequency characteristics can be obtained because the relative permittivity of the borosilicate glass is relatively low.

In the multilayer coil component according to preferred embodiments of the present disclosure, preferably, the first dielectric glass layer and the pair of second dielectric glass layers further contain quartz. The relative permittivity of quartz is further lower than the relative permittivity of the borosilicate glass. Therefore, a multilayer coil component having lower relative permittivity can be obtained, and the high-frequency characteristics can be further improved.

In the multilayer coil component according to preferred embodiments of the present disclosure, preferably, the pair of second dielectric glass layers further contains forsterite. Forsterite has high flexural strength. Therefore, when the second dielectric glass layer contains forsterite, a multilayer coil component having further enhanced mechanical strength can be obtained.

In the multilayer coil component according to preferred embodiments of the present disclosure, preferably, the pair of second dielectric glass layers further contains a ferrite material containing at least Fe, Ni, Zn, and Cu. The ferrite material has high flexural strength. Therefore, when the second dielectric glass layer contains the ferrite material, a multilayer coil component having further enhanced mechanical strength can be obtained. In this case, a content of the ferrite material is preferably about 10% to 60% by volume.

In the multilayer coil component according to preferred embodiments of the present disclosure, a porosity of each of the pair of magnetic layers is preferably about 1% to 13% on an area ratio basis. Consequently, the magnetic layer is densely sintered. Therefore, the strength of the magnetic layer is enhanced, and even when thermal shock is applied or a substrate is distorted during mounting, the occurrence of structural defects, e.g., cracks, in the magnetic layer can be suppressed.

In the multilayer coil component according to preferred embodiments of the present disclosure, preferably, the internal conductor is formed into a substantially spiral or helical shape. The multilayer coil component according to preferred embodiments of the present disclosure is preferably a multilayer common mode choke coil.

Consequently, a multilayer common mode choke coil having high strength and good high-frequency characteristics can be obtained.

Other features, elements, characteristics and advantages of the present disclosure will become more apparent from the following detailed description of preferred embodiments of the present disclosure with reference to the attached drawings.

DETAILED DESCRIPTION

Next, an embodiment according to the present disclosure will be described.

Figure 1:
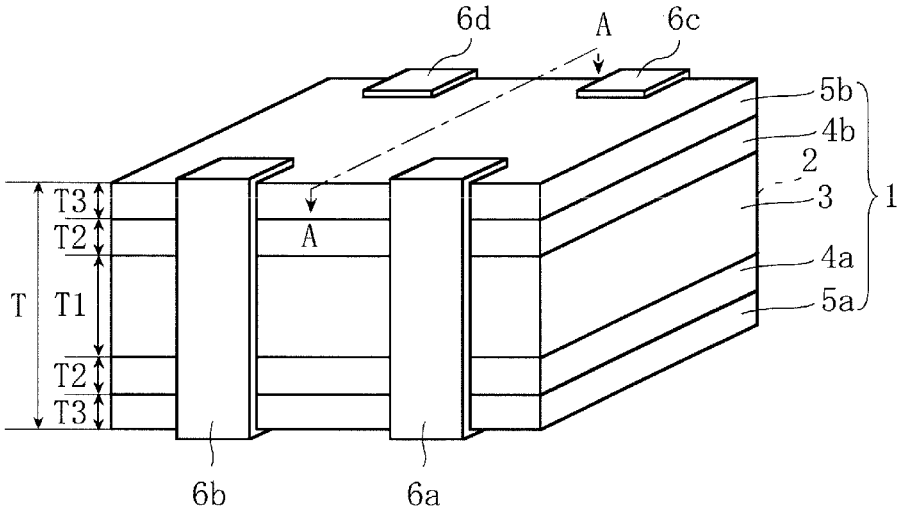
FIG. 1 is a schematic perspective view illustrating an example of a multilayer common mode choke coil as a multilayer coil component according to an embodiment of the present disclosure.
Figure 2:
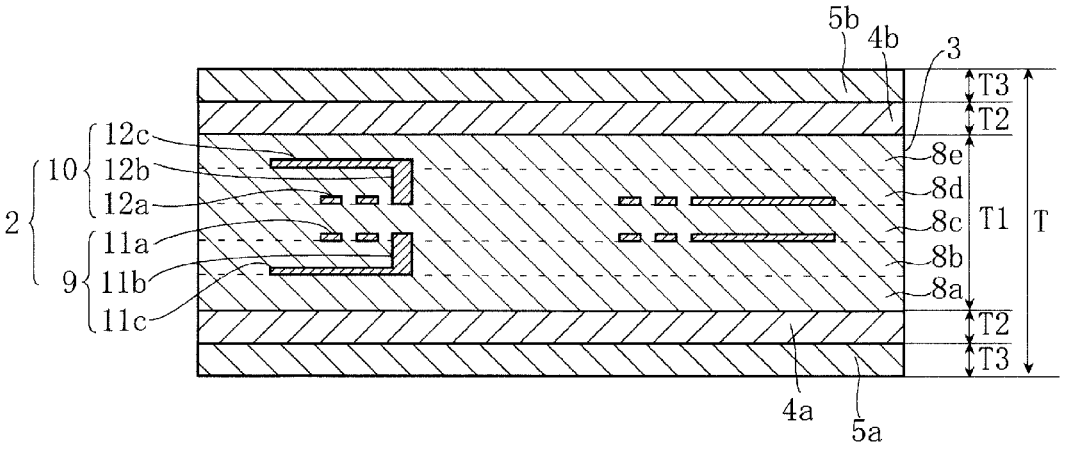
FIG. 2 is a sectional view along line A-A in FIG. 1.

FIG. 1 is a schematic perspective view illustrating an example of a multilayer common mode choke coil as a multilayer coil component according to an embodiment of the present disclosure. FIG. 2 is a sectional view along line A-A in FIG. 1.

Regarding the multilayer common mode choke coil, a component main body 1 has a multilayer structure having a thickness T and in which a first dielectric glass layer 3 in which an internal conductor 2 is embedded and having a thickness T1 is interposed between a pair of magnetic layers 4*a* and 4*b* containing a ferrite material as a primary component, and each of a pair of second dielectric glass layers 5*a* and 5*b* is disposed on one of principal surfaces of the pair of magnetic layers 4*a* and 4*b*. First to fourth outer electrodes 6*a* to 6*d* are disposed on both end portions of the component main body 1.

As illustrated in FIG. 2, the first dielectric glass layer 3 is composed of a sintered body in which first to fifth dielectric glass sheets 8*a* to 8*e* are stacked. The internal conductor 2 includes a first coil conductor 9 and a second coil conductor 10 that are formed into a substantially coiled shape (spiral shape) so as to have the same winding direction, and the first coil conductor 9 and the second coil conductor 10 are embedded in the first dielectric glass layer 3. The first coil conductor 9 includes a first coil portion 11*a* disposed on the second dielectric glass sheet 8*b*, a first conduction via 11*b* that passes through the second dielectric glass sheet 8*b*, and a first extended conductor portion 11*c* disposed on the first dielectric glass sheet 8*a*, and the first coil portion 11*a*, the first conduction via 11*b*, and the first extended conductor portion 11*c* are electrically connected to each other. Meanwhile, the second coil conductor 10 includes a second coil portion 12*a* disposed on the third dielectric glass sheet 8*c*, a second conduction via 12*b* that passes through the fourth dielectric glass sheet 8*d*, and a second extended conductor portion 12*c* disposed on the fourth dielectric glass sheet 8*d*, and the second coil portion 12*a*, the second conduction via 12*b*, and the second extended conductor portion 12*c* are electrically connected to each other. The multilayer common mode choke coil is arranged such that the second dielectric glass layer 5*a* faces a mounting substrate (not illustrated in the drawing) and is connected to the mounting substrate with solder interposed therebetween.

When a normal mode current passes through the first coil conductor 9 and the second coil conductor 10, a magnetic flux is generated in the first coil conductor 9 and in the second coil conductor 10, and the flux in the first coil conductor 9 cancels out the flux in the second coil conductor 10 due to having an opposite direction. Therefore, the multilayer common mode choke coil having the above-described configuration does not function as an inductor. On the other hand, when a common mode current passes through the first coil conductor 9 and the second coil conductor 10, a magnetic flux is generated in the first coil conductor 9 and in the second coil conductor 10, and the direction of the flux in each conductor is the same. Therefore, the multilayer common mode choke coil functions as an inductor. Consequently, the multilayer common mode choke coil does not function as the inductor in the normal mode but functions as the inductor in the common mode so as to remove a noise component.

In the present disclosure, at least one of the second dielectric glass layers 5*a* and 5*b* is formed so as to have a thickness T3 of about 10 μm to 64 μm. The thickness T3 of the second dielectric glass layer 5*a* that faces the mounting substrate is small. Therefore, the compressive stress of the surface of the second dielectric glass layer 5*a* can be enhanced, the mechanical strength can be improved, and the occurrence of structural defects, e.g., cracks, can thereby be suppressed without the occurrence of interlayer peeling in the multilayer body.

That is, the glass material has a smaller coefficient of linear expansion than the ferrite material and, therefore, compressive stress is applied to the second dielectric glass layer 5*a* that faces the mounting substrate during cooling from high temperature to ambient temperature during baking treatment in a firing step or an outer electrode formation step. In this regard, according to the result of the research by the present inventors, it was found that the thickness T3 of the second dielectric glass layer 5*a* that faced the mounting substrate had an influence on the compressive stress and that when the thickness T3 of the second dielectric glass layer 5*a* was decreased and the thickness T3 of the second dielectric glass layer 5*a* was set to be about 10 μm to 64 μm, a desired compressive stress could be produced, thereby enhancing the mechanical strength.

That is, if the thickness T3 of each of the second dielectric glass layers 5*a* and 5*b* is less than 10 μm, the second dielectric glass layers 5*a* and 5*b* cannot perform the function of constraining the magnetic layers 4*a* and 4*b* and the first dielectric glass layer 3, and interlayer peeling may occur at the interfaces between the magnetic layers 4*a* and 4*b* and the first dielectric glass layer 3 or a structural defect, e.g., a crack, may occur in the second dielectric glass layer 5*a*. On the other hand, if the thickness T3 of each of the second dielectric glass layers 5*a* and 5*b* is more than 64 μm, sufficient compressive stress is not applied to the second dielectric glass layer 5*a*, tensile stress may act on the second dielectric glass layer 5*a*, and a structural defect, e.g., a crack, may occur in the second dielectric glass layer 5*a*.

In consideration of the requirement for a reduction in profile, it is preferable that the total thickness T of the multilayer common mode choke coil be set to be about 0.5 mm or less. From this point of view, the ratio of the thickness T3 of one of the second dielectric glass layers 5*a* and 5*b* to the total thickness (T2+T3) of one of the magnetic layers 4*a* and 4*b* and one of the second dielectric glass layers 5*a* and 5*b*, that is, the value of {T3/(T2+T3)}, is preferably about 0.05 to 0.35.

There is no particular limitation regarding the glass material for forming the first dielectric glass layer 3 and the second dielectric glass layers 5*a* and 5*b*, and it is preferable to use a borosilicate glass in which the primary components are Si and B. Borosilicate glass has a relative permittivity of as low as about 4.0 to 5.0, and good high-frequency characteristics can be obtained. For example, borosilicate glass composed of about 70% to 85% by weight of $SiO_2$, about 10% to 25% by weight of $B_2O_3$, about 0.5% to 5% by weight of $K_2O$, and about 0% to 5% by weight of $Al_2O_3$ may be preferably used. It is also preferable that the first dielectric glass layer 3 and the second dielectric glass layers 5*a* and 5*b* contain about 2% to 30% by weight of filler components, e.g., quartz ($SiO_2$), forsterite ($2MgO.SiO_2$), and alumina ($Al_2O_3$).

Quartz has a relative permittivity of about 3.8, and this is a lower value than the relative permittivity of the borosilicate glass. Therefore, for example, when the first dielectric glass layer 3 contains quartz within the range of about 2% to 30% by weight, the relative permittivity of the first dielectric glass layer 3 can be further decreased, and the high-frequency characteristics can be further improved.

It is also preferable that the second dielectric glass layers 5*a* and 5*b* serving as the outer layers of the magnetic layers 4*a* and 4*b* contain forsterite in addition to the quartz or instead of the quartz. Forsterite has a relative permittivity of about 6.5, which is higher than the relative permittivity of the borosilicate glass or quartz, but flexural strength is high and mechanical strength can be enhanced. Therefore, from the viewpoint of enhancing mechanical strength such that a structural defect, e.g., a crack, is not caused, for example, it is preferable that the second dielectric glass layers 5*a* and 5*b* contain forsterite within the range of about 2% to 30% by weight in total in addition to the quartz or instead of the quartz.

Further, it is also preferable that the second dielectric glass layers 5*a* and 5*b* contain a ferrite material instead of the quartz or forsterite or in addition to the quartz or forsterite. Ferrite material has a relative permittivity of about 10, which is higher than the relative permittivity of the borosilicate glass, but flexural strength is high and mechanical strength can be enhanced. Therefore, from the viewpoint of enhancing mechanical strength such that a structural defect, e.g., a crack, is not caused, for example, it is preferable that the second dielectric glass layers 5*a* and 5*b* contain a ferrite material within the range of about 10% to 60% by volume in total.

There is no particular limitation regarding the ferrite material for forming the magnetic layers 4*a* and 4*b* and the ferrite material that may be contained in the second dielectric glass layers 5*a* and 5*b*. For example, a Zn—Cu—Ni-based ferrite material, a Zn—Ni-based ferrite material, and a Ni-based ferrite material that have a spinel crystal structure may be used, and preferably a Zn—Cu—Ni-based ferrite material having shrinkage behavior close to the shrinkage behavior of the glass material may be used. In this case, there is no particular limitation regarding the composition range of the ferrite material. For example, in the case of the Zn—Cu—Ni-based ferrite material, a preferable composition may be set to be about 40% to 49.5% by mole of $Fe_2O_3$, about 5% to 35% by mole of ZnO, and about 4% to 12% by mole of CuO, with the remainder being NiO and a very small amount of additives (including inevitable impurities).

The magnetic layers 4*a* and 4*b* have a porosity of preferably about 1% to 13% on an area ratio basis. Consequently, the magnetic layer is densely sintered. Therefore, the strength of the magnetic layer is enhanced, and even when thermal shock is applied or a mounting substrate is distorted during mounting, the occurrence of structural defects, e.g., cracks, in the magnetic layer can be further suppressed. Further, when the porosity is set to be about 1% to 5% on an area ratio basis, the insulation resistance increases, and growth of plating during formation of the outer electrode can be suppressed.

There is no particular limitation regarding a conductor material for forming the first coil conductor 9 and the second coil conductor 10, and various conductive materials, e.g., Ag, Ag—Pd, Au, Cu, and Ni, may be used. A relatively inexpensive conductive material that can be fired in an air atmosphere and that contains Ag as a primary component is preferably usually used.

Next, a method for manufacturing the above-described multilayer common mode choke coil will be described in detail.

Figure 3:
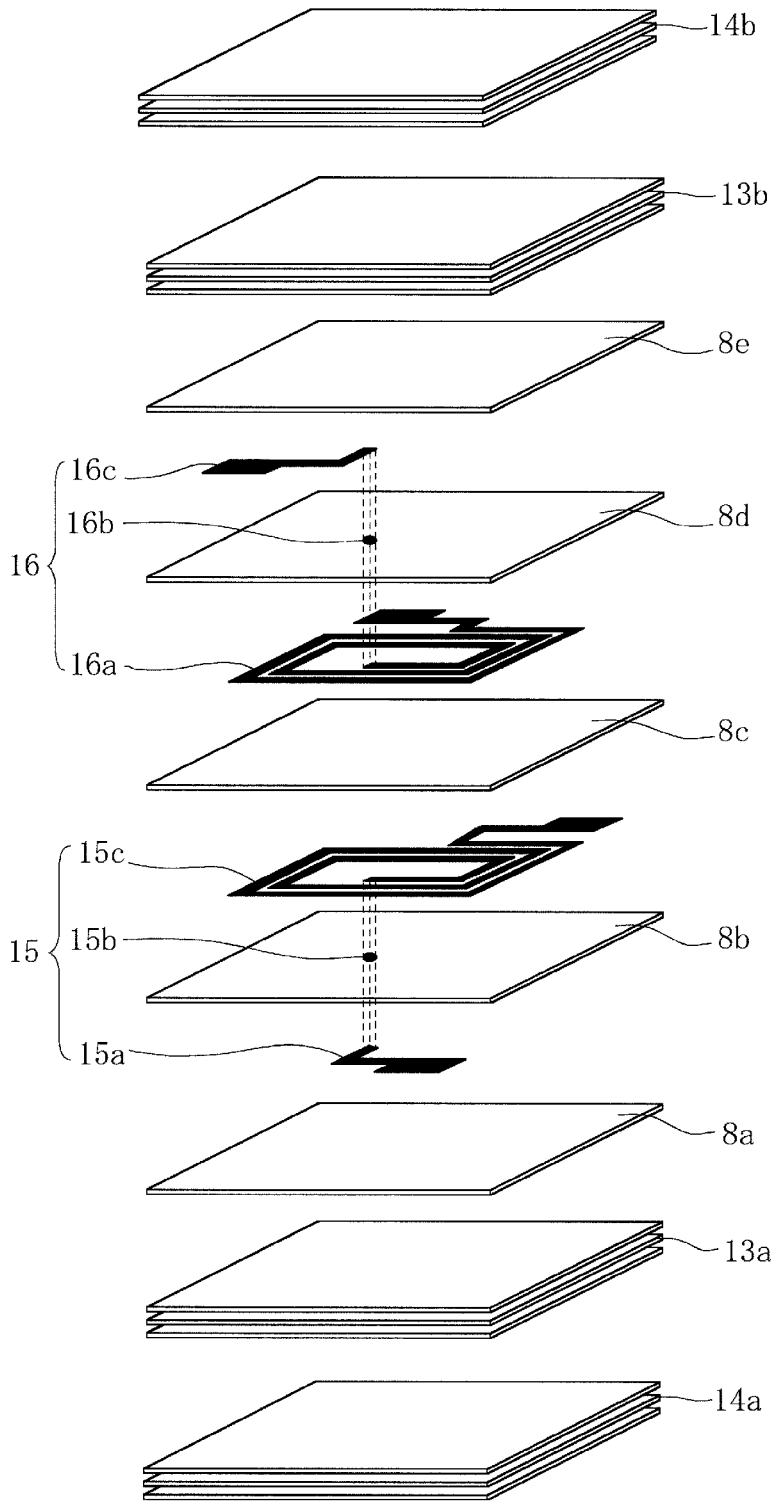
FIG. 3 is an exploded schematic perspective view illustrating a multilayer molded body.
Figure 4:
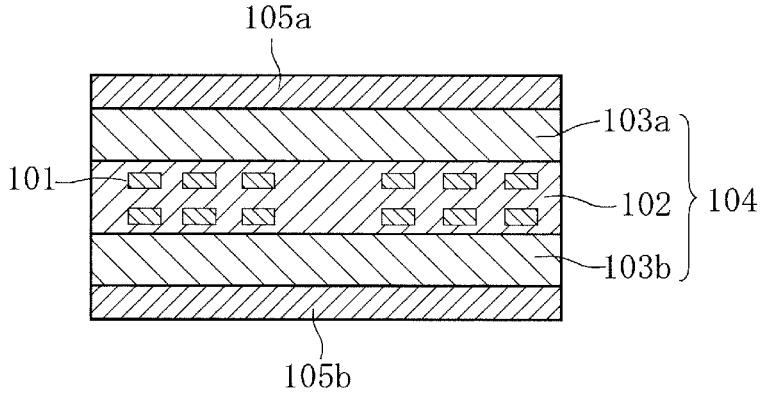
FIG. 4 is a sectional view illustrating a multilayer common mode choke coil described in Japanese Unexamined Patent Application Publication No. 2017-73475.
Figure 5:
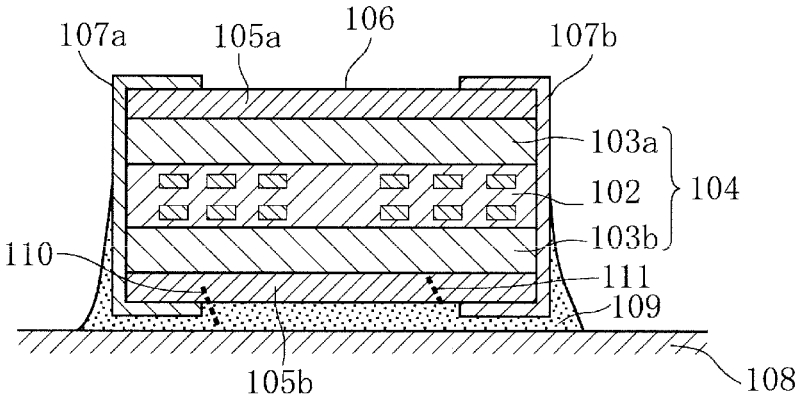
FIG. 5 is a diagram illustrating problems related to Japanese Unexamined Patent Application Publication No. 2017-73475.

FIG. 3 is an exploded schematic perspective view illustrating a multilayer molded body that is an intermediate product of the multilayer common mode choke coil.

Production of Magnetic Sheets 13*a* and 13*b*

Predetermined amounts of ferrite raw materials, e.g., $Fe_2O_3$, ZnO, CuO, and NiO, are weighed. The weighed materials, pure water, and pebbles, e.g., PSZ (partially stabilized zirconia) balls, are placed into a pot mill, and wet mixing and pulverization are sufficiently performed. After performing evaporation and drying, calcination is performed at a temperature of about 700° C. to 800° C. for a predetermined time so as to produce a calcined powder.

The resulting calcined powder, an organic binder, e.g., polyvinylbutyral, an organic solvent, e.g., ethanol or toluene, and PSZ balls are placed into a pot mill again, and mixing and pulverization are sufficiently performed so as to produce a magnetic slurry.

A molding method, e.g., a doctor blade method, is used, and the magnetic slurry is formed into the shape of a sheet so as to obtain a plurality of magnetic sheets 13*a* and 13*b* having a film thickness of about 30 μm to 40 μm.

Production of First to Fifth Dielectric Glass Sheets 8*a* to 8*e* and Outer Layer Dielectric Glass Sheets 14*a* and 14*b*

Glass raw materials, e.g., a Si compound and a B compound, are weighed such that a composition of a glass component after firing becomes a predetermined composition. The resulting weighed material is placed into a platinum crucible, and fusing is performed at a temperature of about 1,500° C. to 1,600° C. for a predetermined time so as to produce a glass melt. The resulting glass melt is rapid-cooled and pulverized so as to produce a glass powder.

As the situation demands, the resulting glass powder is mixed with a predetermined amount of a filler component, e.g., quartz, forsterite, or alumina, and the resulting mixture, an organic binder, e.g., polyvinylbutyral, an organic solvent, e.g., ethanol or toluene, a plasticizer, and PSZ balls are placed into a pot mill, and mixing and pulverization are sufficiently performed so as to produce a dielectric glass slurry.

A molding method, e.g., a doctor blade method, is used, and the dielectric glass slurry is formed into the shape of a sheet so as to produce the first to fifth dielectric glass sheets 8*a* to 8*e* and the outer layer dielectric glass sheets 14*a* and 14*b* that have a film thickness of about 10 μm to 30 μm.

Production of First Conductive Film 15 and Second Conductive Film 16

A conductive paste containing Ag or the like as a primary component is prepared. A coating method, e.g., a screen printing method, is used, and the first dielectric glass sheet 8*a* is coated with the conductive paste so as to produce a first extended conductor pattern 15*a* having a predetermined shape. A via hole is formed at a predetermined location of the second dielectric glass sheet 8*b* by laser irradiation or the like, and the via hole is filled with the conductive paste so as to form the first via conductor 15*b*. A coating method, e.g., a screen printing method, is used, and a first coil pattern 15*c* is formed into a substantially spiral shape on the dielectric glass sheet 8*b* so as to produce a first conductive film 15 composed of the first extended conductor pattern 15*a*, the first via conductor 15*b*, and the first coil pattern 15*c*.

Likewise, a coating method, e.g., a screen printing method, is used, and the third dielectric glass sheet 8*c* is coated with the conductive paste so as to produce a second coil pattern 16*a* having a substantially spiral shape. A via hole is formed at a predetermined location of the fourth dielectric glass sheet 8*d* by laser irradiation or the like, and the via hole is filled with the conductive paste so as to form the second via conductor 16*b*. A coating method, e.g., a screen printing method, is used, and a second extended conductor pattern 16*c* is formed on the fourth dielectric glass sheet 8*d* so as to produce a second conductive film 16 composed of the second coil pattern 16*a*, the second via conductor 16*b*, and the second extended conductor pattern 16*c*.

Production of Multilayer Common Mode Choke Coil

A predetermined number of outer layer dielectric glass sheets 14*a* are stacked such that the thickness of the second dielectric glass layer 5*a* after firing is about 10 μm to 64 μm, and the magnetic sheets 13*a* are stacked. The first to fifth dielectric glass sheets 8*a* to 8*e* provided with the first conductive film 15 and the second conductive film 16 are stacked sequentially, and the predetermined number of magnetic sheets 13*b* and the outer layer dielectric glass sheets 14*b* are further stacked on the fifth dielectric glass sheet 8*e*. In this state, heating and pressure bonding are performed so as to produce a multilayer molded body.

The resulting multilayer molded body is placed into a sagger, and debinding treatment is performed in an air atmosphere at a heating temperature of about 350° C. to 500° C. Thereafter, firing treatment is performed at a temperature of about 850° C. to 920° C. for 2 hours so as to co-fire the outer layer dielectric glass sheets 14*a* and 14*b*, the magnetic sheets 13*a* and 13*b*, the first to fifth dielectric glass sheets 8*a* to 8*e*, the first conductive film 15, and the second conductive film 16. Then, a component main body 1 composed of the first dielectric glass layer 3 in which an internal conductor 2 (first coil conductor 9 and second coil conductor 10) is embedded, a pair of magnetic layers 4*a* and 4*b* interposing the first dielectric glass layer 3, and a pair of the second dielectric glass layers 5*a* and 5*b* disposed on the principal surfaces of the magnetic layers 4*a* and 4*b* is obtained.

Subsequently, predetermined locations of both end portions of the component main body 1 are coated with an outer electrode conductive paste containing Ag or the like as a primary component, and baking treatment is performed at a temperature of about 900° C. so as to form underlying electrodes. Ni plating and Sn plating are performed sequentially on each underlying electrode so as to form a Ni coating and a Sn coating on the underlying electrode. In this manner, the first to fourth outer electrodes 6*a* to 6*d* are produced. That is, the first extended conductor portion 11*c* is electrically connected to the first outer electrode 6*a*, and the first coil portion 11*a* is electrically connected to the third outer electrode 6*c*. The second coil portion 12*a* is electrically connected to the fourth outer electrode 6*d*, and the second extended conductor portion 12*c* is electrically connected to the second outer electrode 6*b*. In this manner, the multilayer common mode choke coil as illustrated in FIG. 1 and FIG. 2 is produced.

The present disclosure is not limited to the above-described embodiment. For example, in the above-described embodiment, the thickness T3 of each of the pair of the second dielectric glass layers 5*a* and 5*b* is set to be equal to each other. However, in the present disclosure, it is important that the thickness of the second dielectric glass layer 5*a* that faces the mounting substrate be set to be about 10 μm to 64 μm so as to enhance the compressive stress. Therefore, there is no particular limitation regarding the thickness of the second dielectric glass layer 5*b* opposite to the second dielectric glass layer 5*a*.

Regarding the materials for forming the first dielectric glass layer 3, the second dielectric glass layers 5*a* and 5*b*, and the magnetic layers 4*a* and 4*b*, additives may be appropriately included in addition to the above-described materials within the bounds of not affecting the performance.

In the above-described embodiment, two internal conductors 2 (first coil conductor 9 and second coil conductor 10) having a substantially spiral coil shape are embedded in the first dielectric glass layer 3. However, there is no particular limitation regarding the form of the internal conductor as long as a coiled shape is adopted, and an internal conductor formed into a substantially helical shape via a plurality of conduction vias may be embedded in the first dielectric glass layer 3. In the above-described embodiment, the multilayer common mode choke coil is described as an example, but it is needless to say that the present disclosure can be applied to other multilayer coil components.

Next, examples according to the present disclosure will be specifically described.

Example 1

Production of Sample

Production of Magnetic Sheet

Predetermined amounts of ferrite raw materials were weighed such that $Fe_2O_3$ was 48% by mole, ZnO was 26% by mole, CuO was 8% by mole, and the remainder was NiO. The weighed materials, pure water, and pebbles, e.g., PSZ (partially stabilized zirconia) balls, were placed into a pot mill, and wet mixing and pulverization were sufficiently performed. After performing evaporation and drying, calcination was performed at a temperature of 700° C. to 800° C. for a predetermined time so as to produce a calcined powder.

The resulting calcined powder, an organic binder, e.g., polyvinylbutyral, an organic solvent, e.g., ethanol or toluene, and PSZ balls were placed into a pot mill again, and mixing and pulverization were sufficiently performed so as to produce a magnetic slurry.

A doctor blade method was used, and the magnetic slurry was formed into the shape of a sheet so as to obtain magnetic sheets having a film thickness of 30 μm to 40 μm.

Production of Dielectric Glass Sheet

Glass raw materials were weighed such that $SiO_2$ was 78% by weight, $B_2O_3$ was 20% by weight, and $K_2O$ was 2% by weight. The weighed materials were placed into a platinum crucible, and fusing was performed at a temperature of 1,500° C. to 1,600° C. for 2 hours in accordance with the composition components so as to produce a glass melt. The resulting glass melt was rapid-cooled and pulverized so as to produce a glass powder having an average particle diameter of 1.0 μm.

A quartz powder and an alumina powder having an average particle diameter of 0.5 μm to 1.5 μm were prepared as filler components. The glass powder, the quartz powder, and the alumina powder were weighed and mixed such that the glass powder was 85% by weight, the quartz powder was 12% by weight, and the alumina powder was 3% by weight. The resulting mixture, an organic binder, e.g., polyvinylbutyral, an organic solvent, e.g., ethanol or toluene, a plasticizer, and PSZ balls were placed into a pot mill, and mixing and pulverization were sufficiently performed so as to produce a dielectric glass slurry.

A doctor blade method was used, and the dielectric glass slurry was formed into the shape of a sheet so as to produce dielectric glass sheets having a film thickness of 7 μm to 30 μm.

Production of Conductive Film

An Ag-based conductive paste was prepared. Some dielectric glass sheets of the above-described dielectric glass sheets were coated with the Ag-based conductive paste by using a screen printing method so as to produce a spiral coil pattern or an extended conductor pattern. Via holes were formed at predetermined locations of some dielectric glass sheets of the other dielectric glass sheets by performing laser irradiation, and the via holes were filled with the Ag-based conductive paste so as to form via conductors.

Firing Treatment

The magnetic sheets, the dielectric glass sheets provided with the conductive films, and the dielectric glass sheet provided with no conductive film were stacked in a predetermined order such that the thickness T1 of the first dielectric glass layer, the thickness T2 of the magnetic layer, and the thickness T3 of the second dielectric glass layer after firing became as shown in Table 1. Pressure bonding was performed by pressurization under heating so as to produce a multilayer molded body. The resulting multilayer molded body was placed into a sagger, and debinding treatment was performed in an air atmosphere at 500° C. Thereafter, firing was performed at a firing temperature of 900° C. for 2 hours so as to obtain component main bodies of sample Nos. 1 to 6.

Formation of Outer Electrode

Both end portions of the resulting component main body were coated with the Ag-based conductive paste, and baking treatment was performed at a temperature of 900° C. so as to form underlying electrodes. Ni plating and Sn plating were performed sequentially on each underlying electrode so as to form a Ni coating and a Sn coating on the underlying electrode. In this manner, the first to fourth outer electrodes were produced and specimens of sample Nos. 1 to 6 were obtained.

Regarding the external dimension of the resulting sample, the length L was 0.8 mm, the width W was 0.65 mm, and the thickness T was 0.45 mm Evaluation of Sample Inspections before reflow of 30 specimens of each of sample Nos. 1 to 6 were performed. That is, the specimen surface of each of 30 specimens was observed by an optical microscope, and it was examined whether there was interlayer peeling or a structural defect, e.g., a crack, before reflow heating treatment. When a structural defect was observed in at least one of 30 specimens, the sample was rated as being defective (x).

Samples rated as being good by the inspection before reflow were subjected to reflow heating treatment so as to examine whether a structural defect occurred. That is, a glass epoxy resin mounting substrate provided with a land electrode on the surface was prepared. The land electrode was coated with a Sn—Ag—Cu-based solder paste, 30 specimens were mounted on the solder paste applied, and heating treatment was performed under the reflow condition described below.

Reflow Condition

Reflow furnace: TNR25-435PH produced by TAMURA CORPORATION

Conveyer speed: 0.75 m/min

Blower rotational speed: 2,500 rpm

Maximum temperature: 230° C.

Each specimen after heating treatment was polished in the plane direction and, thereafter, the polished surface was observed by an optical microscope so as to examine whether there was a structural defect, e.g., a crack. When a structural defect was observed in at least one of 30 specimens, the sample was rated as being defective (x).

Table 1 shows each of the thickness T1 of the first dielectric glass layer, the thickness T2 of the magnetic layer, and the thickness T3 of the second dielectric glass layer, the ratio of the thickness T3 of the second dielectric glass layer to the total thickness (T2+T3) of the magnetic layer and the second dielectric glass layer, that is, the value of {T3/(T2+T3)}, and the occurrence of a structural defect before and after reflow of each of sample Nos. 1 to 6.

TABLE 1

| Sample No. | Thickness of specimen (μm) First dielectric glass layer T1 | Magnetic layer T2 | Second dielectric glass layer T3 | T3/(T2 + T3) | Occurrence of structural defect Before reflow | After reflow |
|---|---|---|---|---|---|---|
| 1*1) | 95 | 182 | 0 | 0 | X | — |
| 2*1) | 93 | 179 | 7 | 0.04 | X | — |
| 3 | 94 | 174 | 10 | 0.05 | ○ | ○ |
| 4 | 92 | 159 | 28 | 0.15 | ○ | ○ |
| 5 | 94 | 122 | 64 | 0.34 | ○ | ○ |
| 6*1) | 95 | 102 | 80 | 0.44 | ○ | X |

*1)is out of the scope of the present disclosure

Reflow Condition

Regarding sample No. 1, the second dielectric glass layer was not disposed, and the first dielectric glass layer was interposed between merely the magnetic layers. Therefore, a difference in shrinkage behavior between the first dielectric glass layer and the magnetic layer was not sufficiently absorbed, the internal stress was not sufficiently relaxed, and interlayer peeling or a structural defect, e.g., a crack, occurred.

Regarding sample No. 2, the thickness of the second dielectric glass layer was as small as 7 μm. Therefore, interlayer peeling or a structural defect, e.g., a crack, occurred for the same reason as in sample No. 1.

Meanwhile, regarding sample No. 6, an internal stress between the first dielectric glass layer and the magnetic layer was relaxed sufficiently, and neither interlayer peeling nor a structural defect, e.g., a crack, occurred in the inspection before reflow. However, the thickness T3 of the second dielectric glass layer was as large as 80 μm and, therefore, tensile stress was applied to the second dielectric glass layer due to thermal shock or the like during reflow heating treatment. As a result, a structural defect, e.g., a crack, occurred in the second dielectric glass layer.

On the other hand, regarding sample Nos. 3 to 5, the thickness T3 of the second dielectric glass layer was 10 μm to 64 μm and was within the scope of the present disclosure. Therefore, it was found that neither interlayer peeling nor a structural defect, e.g., a crack, occurred before reflow and after reflow.

In addition, it was found that the ratio of the thickness T3 of the second dielectric glass layer to the total thickness (T2+T3) of the second dielectric glass layer and the magnetic layer, that is, the value of {T3/(T2+T3)}, was preferably about 0.05 to 0.35.

Example 2

Specimens of sample Nos. 11 to 17 were produced in the same method and procedure as in sample No. 4 of example 1 except that the glass compositions of the first dielectric glass layer and the second dielectric glass layer were adjusted so as to have the quartz and/or forsterite content shown in Table 2.

Each of the specimens of sample Nos. 11 to 17 was subjected to heating treatment under the same reflow condition as in example 1 except that the maximum temperature was set to be 230° C. or 270° C.

Each specimen after heating treatment was evaluated in the same manner as in example 1. When a structural defect was observed in at least one of 30 specimens, the sample was rated as being defective (x).

TABLE 2

| Sample No. | First dielectric glass layer (% by weight) Glass material | Quartz | Second dielectric glass layer (% by weight) Glass material | Forsterite | Quartz | Occurrence of structural defect after reflow Temperature 230° C. | Temperature 270° C. |
|---|---|---|---|---|---|---|---|
| 11*2) | 100 | 0 | 100 | 0 | 0 | ○ | X |
| 12 | 100 | 0 | 98 | 2 | 0 | ○ | ○ |
| 13 | 100 | 0 | 80 | 20 | 0 | ○ | ○ |
| 14 | 100 | 0 | 70 | 30 | 0 | ○ | ○ |
| 15 | 100 | 0 | 70 | 15 | 15 | ○ | ○ |
| 16 | 70 | 30 | 70 | 15 | 15 | ○ | ○ |
| 17 | 70 | 30 | 70 | 30 | 0 | ○ | ○ |

*2)is out of the scope of the present disclosure (Claim 5)

As is clear from Table 2, regarding sample No. 11, the second dielectric glass layer contained no forsterite, the mechanical strength was slightly low, and a defect was observed in the reflow heating treatment with the maximum temperature of 270° C., although no defect was observed in the reflow heating treatment with the maximum temperature of 230° C.

On the other hand, regarding sample Nos. 12 to 17, the second dielectric glass layer contained 2% to 30% by weight of forsterite serving as a filler, the mechanical strength of the second dielectric glass layer was enhanced and, as a result, it was ascertained that no structural defect occurred between the magnetic layer and the first dielectric glass layer or between the magnetic layer and the second dielectric glass layer.

Example 3

Specimens of sample Nos. 21 to 25 were produced in the same method and procedure as in sample No. 4 of example 1 except that the first dielectric glass layer was composed of 70% by weight of glass material and 30% by weight of quartz and the ferrite material in a volume content shown in Table 3 was included in the second dielectric glass layer.

The volume contents of the ferrite material and the glass material were determined as described below.

That is, each specimen was stood vertically, and the circumference of the specimen was fixed with a resin such that a LW face regulated by a length L and a width W was exposed at the surface. Polishing was performed downward from the upper portion to the substantially central portion of the magnetic layer by a polishing machine. The resulting polished surface was pictured by a scanning electron microscope (SEM), the SEM image was analyzed by using image analysis software (A-zokun produced by Asahi Kasei Engineering Corporation), and the area of each of a ferrite phase and a glass phase was calculated. In the image region, the ratio of the area of the ferrite phase was assumed to be a volume content of the ferrite phase, and the ratio of the area of the glass phase was assumed to be a volume content of the glass phase.

In this regard, a ferrite material having the same component composition as the magnetic sheet of example 1 was used.

Each of the specimens of sample Nos. 21 to 25 was subjected to reflow heating treatment where the maximum temperature was set to be 230° C. or 270° C. in the same manner as in example 2.

Each specimen after heating treatment was evaluated in the same manner as in example 1. When a structural defect was observed in at least one of 30 specimens, the sample was rated as being defective (x).

TABLE 3

| Sample No. | First dielectric glass layer (% by weight) Glass material | Quartz | Second dielectric glass layer (% by volume) Glass material | Ferrite material | Occurrence of structural defect after reflow Temperature 230° C. | Temperature 270° C. |
|---|---|---|---|---|---|---|
| 21*3) | 70 | 30 | 100 | 0 | ○ | X |
| 22 | 70 | 30 | 90 | 10 | ○ | ○ |
| 23 | 70 | 30 | 70 | 30 | ○ | ○ |
| 24 | 70 | 30 | 55 | 45 | ○ | ○ |
| 25 | 70 | 30 | 40 | 60 | ○ | ○ |

*3)is out of the scope of the present disclosure (Claim 6)

As is clear from Table 3, regarding sample No. 21, the second dielectric glass layer contained no ferrite material, the mechanical strength was slightly low, and a defect was observed in the reflow heating treatment with the maximum temperature of 270° C., although no defect was observed in the reflow heating treatment with the maximum temperature of 230° C.

On the other hand, regarding sample Nos. 22 to 25, the second dielectric glass layer contained 10% to 60% by volume of ferrite material, the mechanical strength of the second dielectric glass layer was enhanced and, as a result, it was ascertained that no structural defect occurred between the magnetic layer and the first dielectric glass layer or between the magnetic layer and the second dielectric glass layer.

Regarding a multilayer coil component of a type in which outer layers are composed of dielectric glass layers, the occurrence of interlayer peeling or structural defects, e.g., cracks, in the dielectric glass layer serving as the outer layer is suppressed even when a substrate is distorted by application of thermal shock during mounting.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a pair of magnetic layers, each disposed on one of principal surfaces of a first dielectric glass layer in which an internal conductor is embedded; and a pair of second dielectric glass layers each disposed on one of principal surfaces of the pair of magnetic layers, wherein at least one of the pair of second dielectric glass layers has a thickness of about 10 μm to 64 μm, and a ratio of the thickness of the one of the pair of second dielectric glass layers to a total thickness of one of the pair of magnetic layers and the one of the pair of second dielectric glass layers is about 0.05 to 0.35.

2. The multilayer coil component according to claim 1, wherein the first dielectric glass layer and the pair of second dielectric glass layers contain a glass material in which a primary component is a borosilicate glass.

3. The multilayer coil component according to claim 2, wherein the first dielectric glass layer and the pair of second dielectric glass layers further contain quartz.

4. The multilayer coil component according to claim 3, wherein the pair of second dielectric glass layers further contains forsterite.

5. The multilayer coil component according to claim 3, wherein the pair of second dielectric glass layers further contains a ferrite material containing at least Fe, Ni, Zn, and Cu.

6. The multilayer coil component according to claim 2, wherein the pair of second dielectric glass layers further contains forsterite.

7. The multilayer coil component according to claim 6, wherein the pair of second dielectric glass layers further contains a ferrite material containing at least Fe, Ni, Zn, and Cu.

8. The multilayer coil component according to claim 2, wherein the pair of second dielectric glass layers further contains a ferrite material containing at least Fe, Ni, Zn, and Cu.

9. The multilayer coil component according to claim 8, wherein a content of the ferrite material is about 10% to 60% by volume.

10. The multilayer coil component according to claim 2, wherein a porosity of each of the pair of magnetic layers is about 1% to 13% on an area ratio basis.

11. The multilayer coil component according to claim 2, wherein the internal conductor is formed into a substantially spiral or helical shape.

12. The multilayer coil component according to claim 2, wherein the multilayer coil component is a multilayer common mode choke coil.

13. The multilayer coil component according to claim 1, wherein a porosity of each of the pair of magnetic layers is about 1% to 13% on an area ratio basis.

14. The multilayer coil component according to claim 1, wherein the internal conductor is formed into a substantially spiral or helical shape.

15. The multilayer coil component according to claim 1, wherein the multilayer coil component is a multilayer common mode choke coil.

* * * * *